US010773851B2

(12) United States Patent
Cooper et al.

(10) Patent No.: US 10,773,851 B2
(45) Date of Patent: Sep. 15, 2020

(54) BASKET

(71) Applicants: David James Cooper, Carlisle (AU); Edward Joseph Khoury, Bateman (AU); Joo Ho Duane Wee, Carlisle (AU)

(72) Inventors: David James Cooper, Carlisle (AU); Edward Joseph Khoury, Bateman (AU); Joo Ho Duane Wee, Carlisle (AU)

( * ) Notice: Subject to any disclaimer, the term of this patent is extended or adjusted under 35 U.S.C. 154(b) by 191 days.

(21) Appl. No.: 16/091,083

(22) PCT Filed: Apr. 4, 2017

(86) PCT No.: PCT/AU2017/050285
§ 371 (c)(1),
(2) Date: Oct. 3, 2018

(87) PCT Pub. No.: WO2017/173483
PCT Pub. Date: Oct. 12, 2017

(65) Prior Publication Data

US 2019/0127113 A1 May 2, 2019

(30) Foreign Application Priority Data

Apr. 5, 2016 (AU) ..... 2016901252

(51) Int. Cl.

| | |
|---|---|
| ***B65D 6/24*** | (2006.01) |
| ***A47B 88/90*** | (2017.01) |
| ***A47B 88/975*** | (2017.01) |
| ***B65D 6/08*** | (2006.01) |
| ***A47F 5/00*** | (2006.01) |
| ***B65D 25/06*** | (2006.01) |

(52) U.S. Cl.
CPC ..... *B65D 11/1873* (2013.01); *A47B 88/941* (2017.01); *A47B 88/975* (2017.01); *A47F 5/0025* (2013.01); *B65D 11/14* (2013.01); *B65D 25/06* (2013.01); *A47F 5/0018* (2013.01)

(58) Field of Classification Search
CPC .... B65D 11/1873; B65D 11/14; B65D 25/06; A47F 5/0025; A47B 88/975; A47B 88/941
USPC ..... 220/4.28
See application file for complete search history.

(56) References Cited

U.S. PATENT DOCUMENTS

| | | | | |
|---|---|---|---|---|
| 3,655,087 A * | 4/1972 | Luisada | ..... | B65D 9/12 220/1.5 |
| 3,877,602 A * | 4/1975 | Clark | ..... | B65D 11/1873 220/4.28 |
| 2007/0075043 A1 * | 4/2007 | Riogonzalez | ..... | B65D 11/1873 217/13 |

(Continued)

*Primary Examiner* — King M Chu
(74) *Attorney, Agent, or Firm* — Tope-McKay & Associates

(57) ABSTRACT

A basket (10) comprising first and second side walls (16, 17) and first and second end walls (18, 19). Upper edges of the side and edge walls (16, 17, 18, 19) include a lip portion (22) and securing clips (34) are located adjacent lower sides of the lip portions (22). A retaining loop (32) is provided such that the retaining loop (32) is locatable around outer surfaces of the first and second side walls (16, 17) and the first and second end walls (18) to be received in the securing clips (34) to secure the first and second side walls (16, 17) and first and second end walls (18, 19) together to define an outer wall (12) of the basket (10).

20 Claims, 14 Drawing Sheets

(56) References Cited

U.S. PATENT DOCUMENTS

| | | | | |
|---|---|---|---|---|
| 2011/0108558 | A1* | 5/2011 | Magni | B65D 11/20<br>220/592.01 |
| 2011/0155610 | A1* | 6/2011 | Carver | B65D 11/1873<br>206/503 |

* cited by examiner

BASKET

FIELD OF THE INVENTION

The present invention relates to a basket for use in shelving storage units.

BACKGROUND TO THE INVENTION

A range of modular systems are available for creating shelving racks of various sizes. It is common to require the use of slidable baskets within such shelving racks and systems are available to provide rails to accommodate such baskets.

Such systems are often provided in a modular form such that the units can be shipped in pieces and assembled on site. The baskets however are generally supplied as complete units. A further issue with such shelving systems, particularly when used in hospitals and similar environments, relates to the ability for the components to remain clean. It is preferable, for example, for baskets to be able to adequately drain to reduce the likelihood that material will build up around the base of the basket.

The present invention relates to a shelving system having features aimed at overcoming, at least in part, the above-mentioned problems.

SUMMARY OF THE INVENTION

According to one aspect of the present invention there is provides basket comprising:

first and second side walls and first and second end walls, wherein upper edges of the side and end walls include a lip portion extending outwardly therefrom;

securing clips located adjacent lower sides of the lip portions of the end and side walls; and a retaining loop being generally rectangular in shape wherein the retaining loop is locatable around outer surfaces of the first and second side walls and the first and second end walls such that the retaining loop is received in the securing clips to secure the first and second side walls and first and second end walls together to define an outer wall of the basket.

Preferably the outer wall formed by the first and second side walls and the first and second end walls includes an inward taper from an upper end to a lower end thereof.

Preferably the securing clips each comprises a projection extending downwardly from a lower surface of the lip portion defining a downwardly facing recess located between the projection and the adjacent side or end wall.

Preferably the downwardly facing recesses are dimensioned to receive the retaining loop in a snap fit type connection.

In a preferred embodiment, the projections are elongate and parallel to the adjacent side or end walls and the loop comprises a wire of circular cross section and inner faces of the projections are arcuate such that the recesses are generally circular in transverse cross section to receive the loop.

Preferably the base extends between lower edges of the first and second side walls and the first and the second end walls and comprises a mesh tray.

In a preferred embodiment, the mesh tray comprises a rectangular outer frame and an inner grill formed from a plurality of cross members extending across between sides and ends of the outer frame.

Preferably each of the side and end side walls are provided with one or more base connectors arranged at intervals on the lower edges thereof to engage with the base.

Preferably the base connectors each comprise an arcuate tab extending on an inner side of the side or end wall to define an upwardly facing channel to receive the outer frame of the base.

In a preferred embodiment, apertures are provided in the inner mesh of the base at locations along the outer frame corresponding to the locations of the base connectors such that the base connectors are received in the apertures.

In a preferred embodiment, the cross members are teardrop-shaped in transverse cross section such that the cross members include a rounded upper edge and inwardly tapering sides such that the width of the cross members decreases towards the lower sides.

Preferably the first and second side walls and the first and second end walls include a plurality of holes therein to allow for air flow within the basket.

In one embodiment, the basket is provided with a divider comprising one or more first members and one or more second members wherein the first members extend between the first and second ends of the basket and the second members extend between the first and second sides.

Preferably ends of the first and second members are provided with lugs to be received in corresponding openings in the side and end walls.

Preferably the ends of the first and second members are each provided with a pair of lugs and each of the side and end walls is provided with a pair of corresponding rows of openings.

Preferably ends of the side walls and the end walls are each provided with end connectors such that ends of each of the side walls can engage with adjacent ends of the end walls.

In one embodiment, the end connectors on the side walls comprise curved tabs located centrally on end edges of the side walls to be received into corresponding recessed portions provided centrally on end edges of the end walls.

Preferably the curved tabs are thinner than the side walls and located adjacent an outer surface of the side walls and the recessed portions include a lip portion located adjacent an inner surface of the end walls to engage with a distal end of the curved tabs.

BRIEF DESCRIPTION OF THE DRAWINGS

The invention will now be described, by way of example, with reference to the following drawings, in which.

DETAILED DESCRIPTION OF PREFERRED EMBODIMENTS

Figure 1:
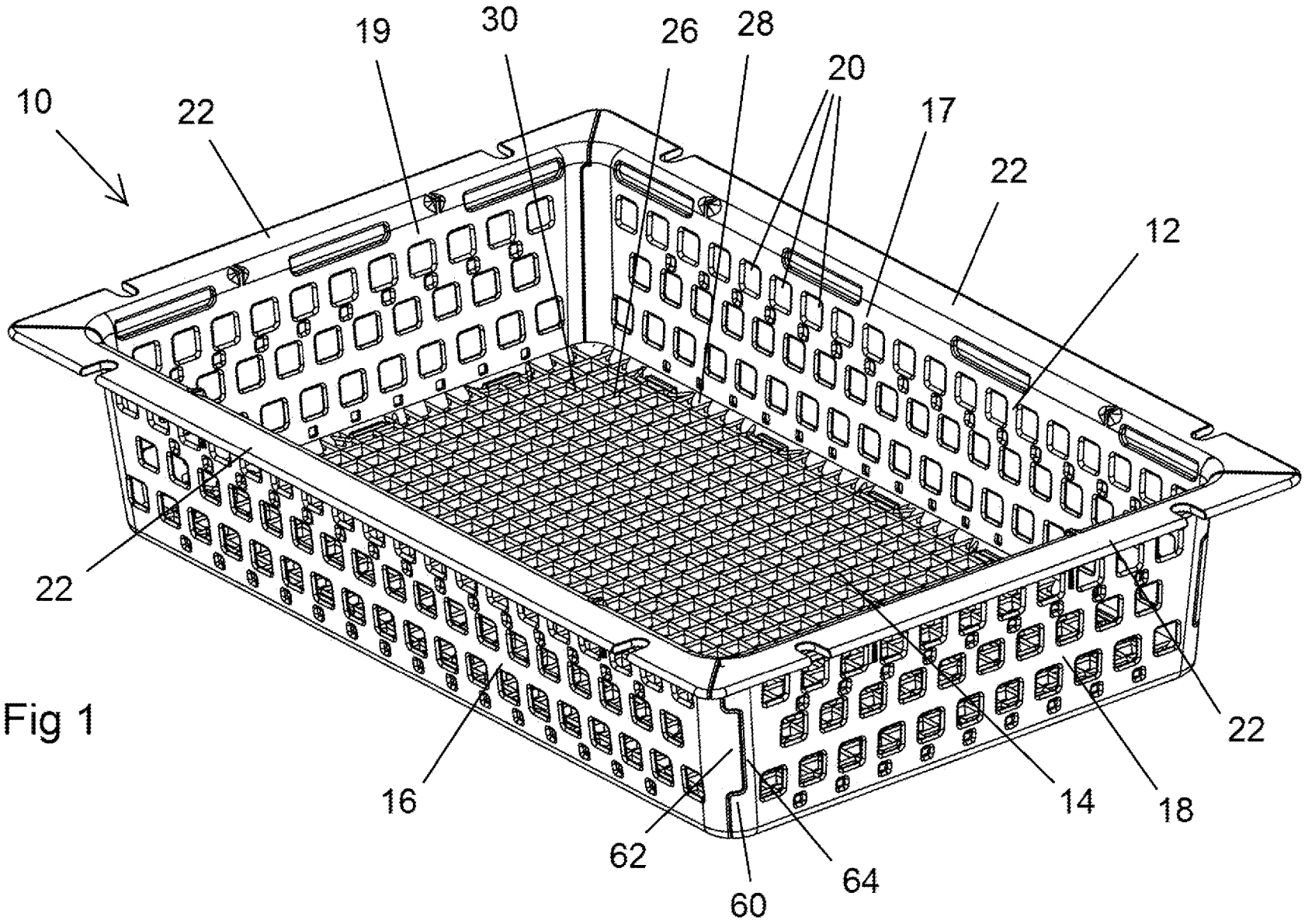
FIG. 1 is an upper perspective view of a basket in accordance with the present invention.
Figure 2:
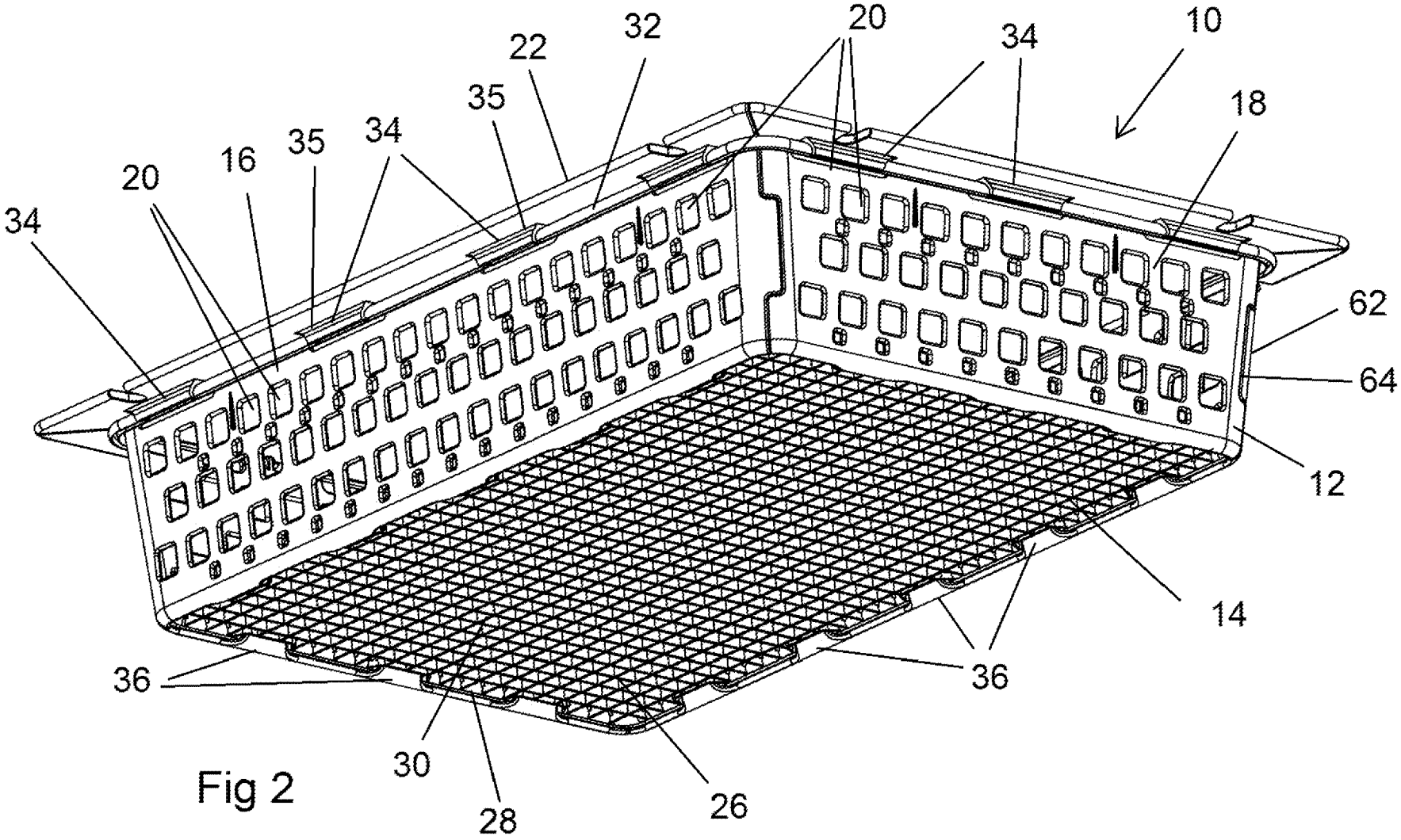
FIG. 2 is a lower perspective view of the basket of FIG. 1.
Figure 3:
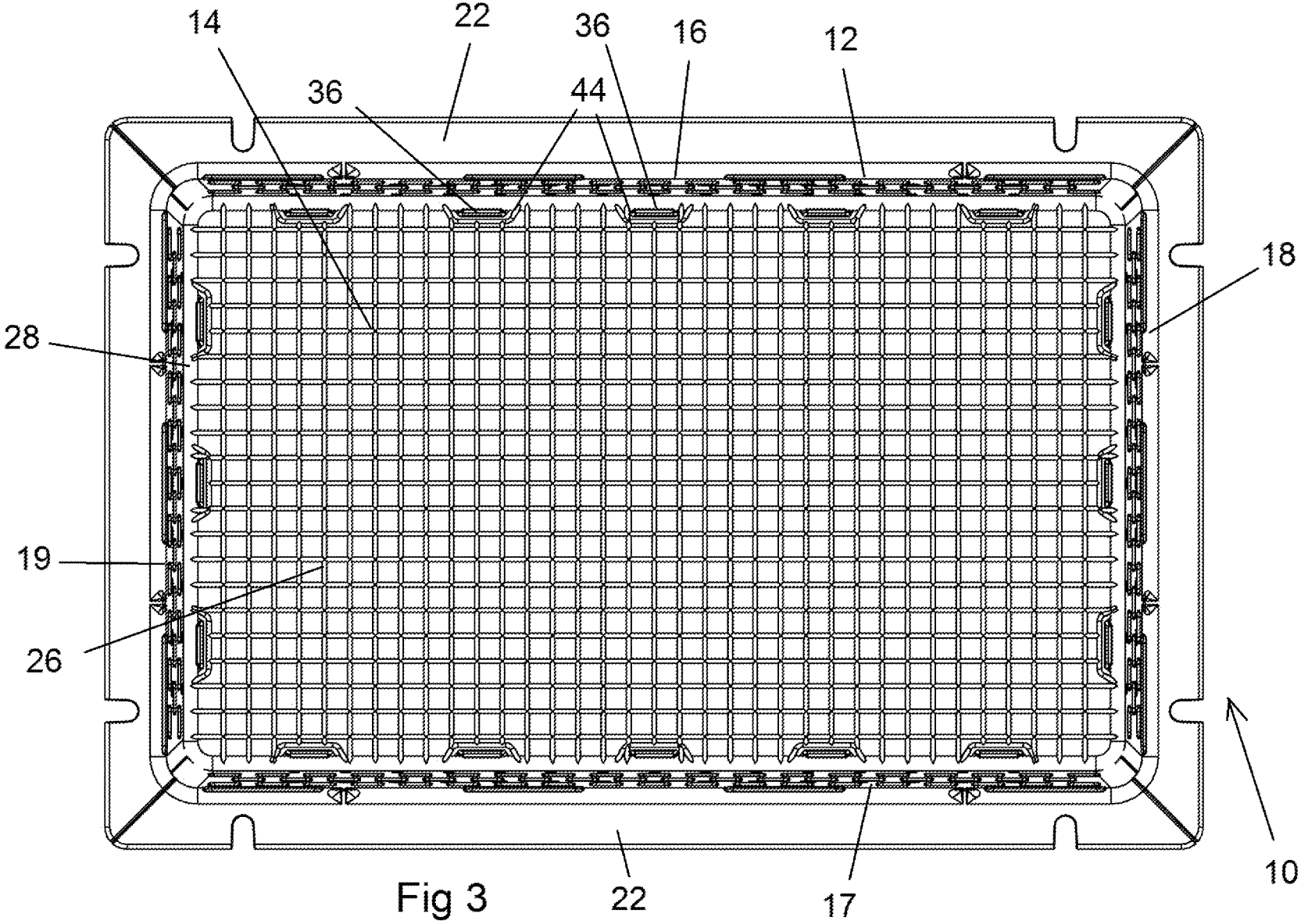
FIG. 3 is a top view of the basket of FIG. 1.
Figure 4:
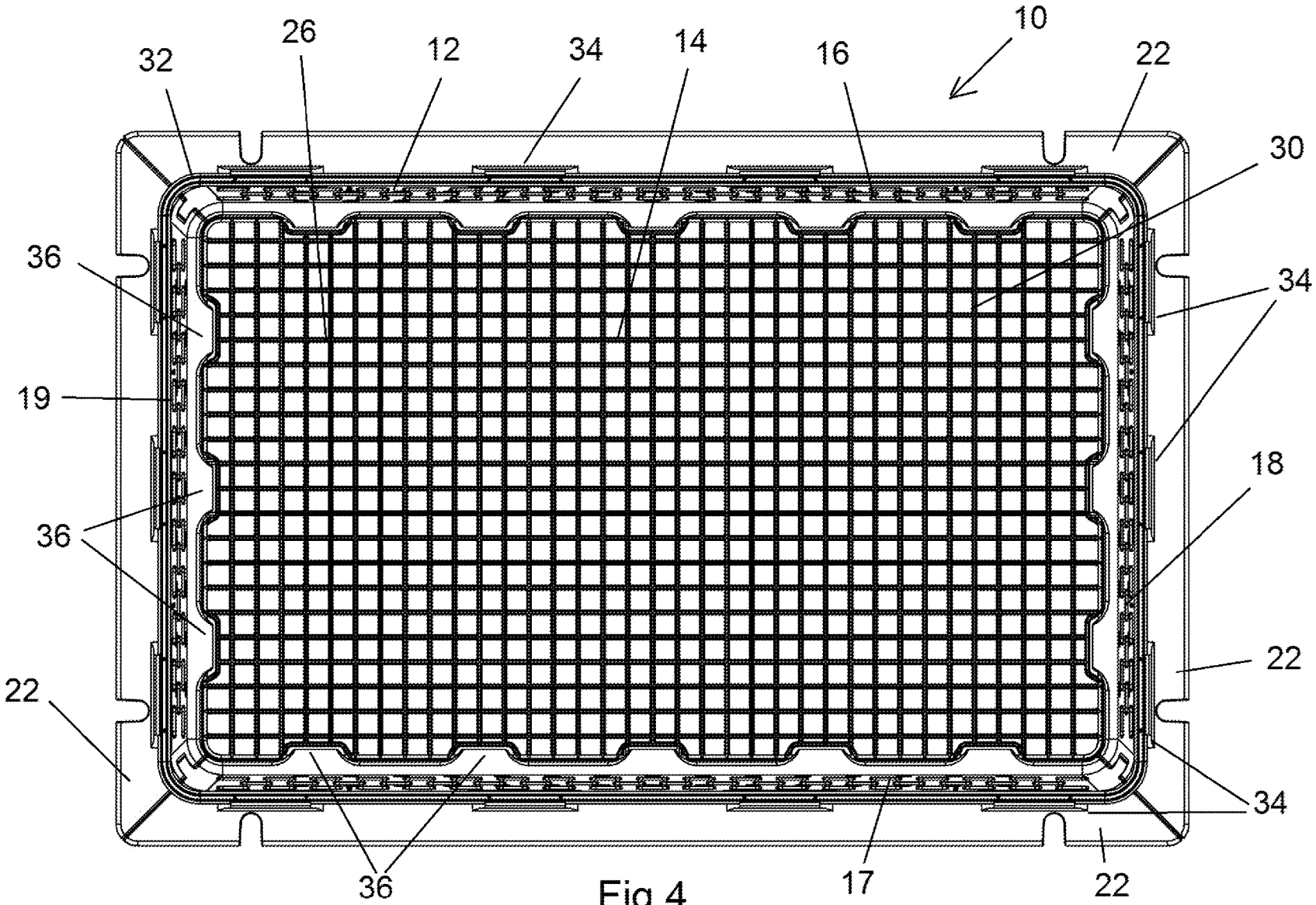
FIG. 4 is a bottom view of the basket of FIG. 1.
Figure 5:
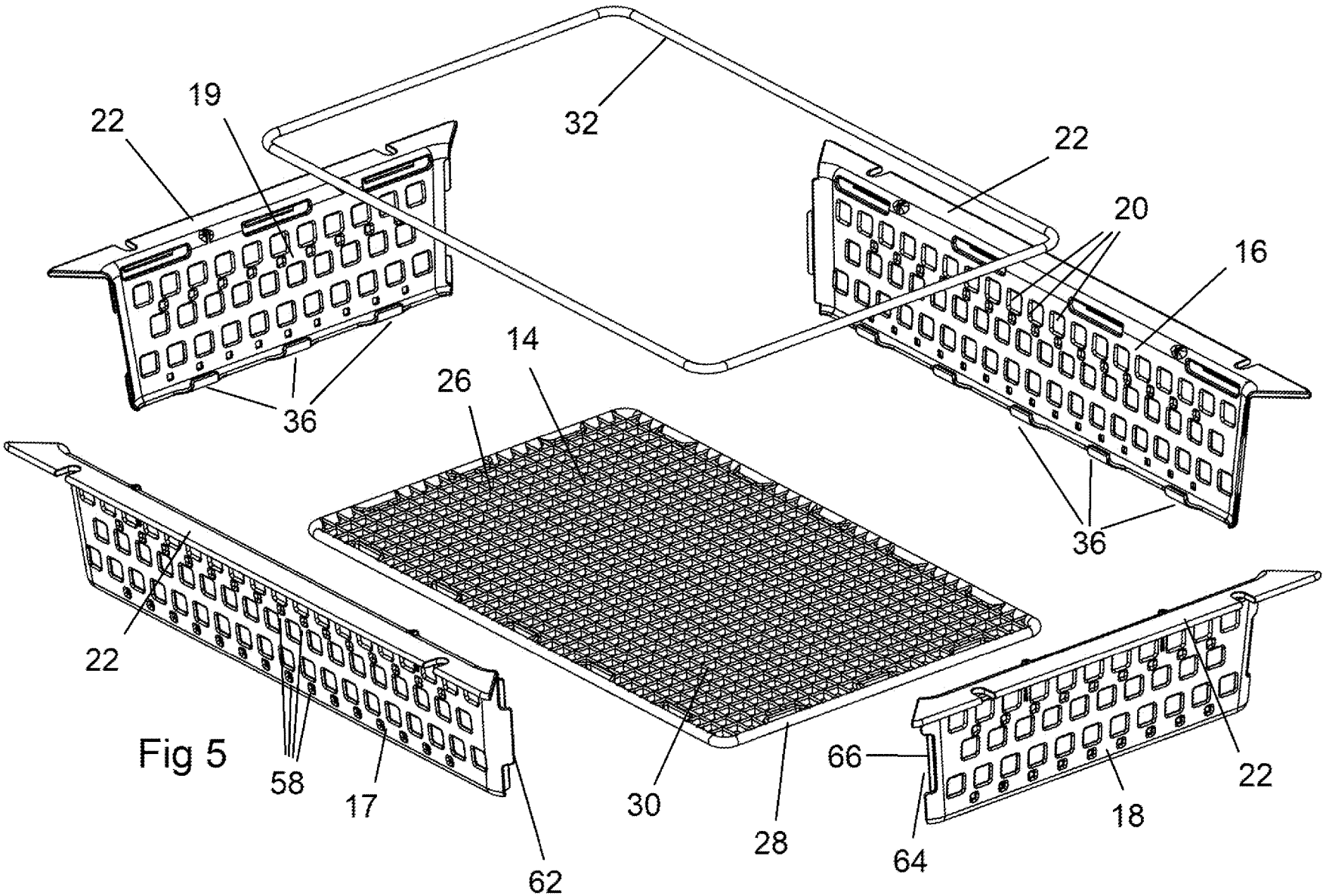
FIG. 5 is an exploded view of the basket of FIG. 1.
Figure 6:
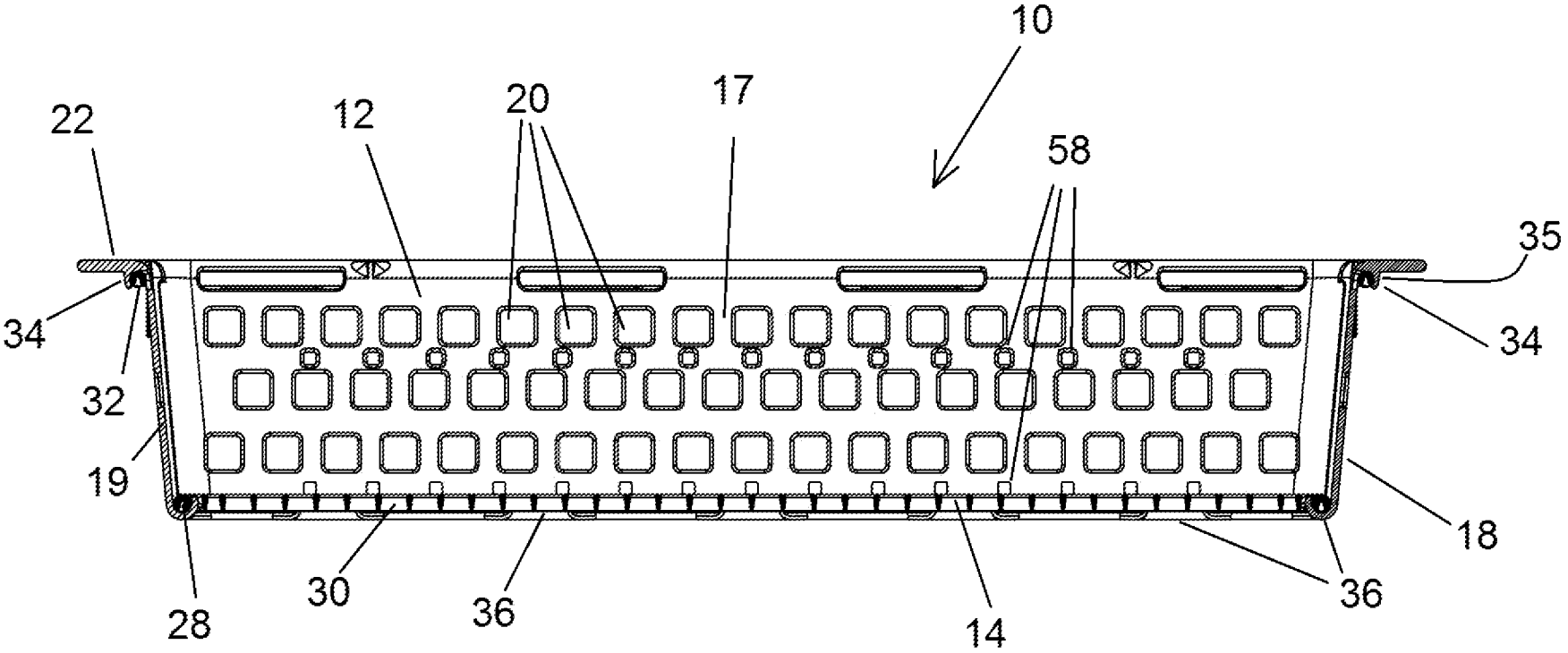
FIG. 6 is a side cross sectional view of the basket of FIG. 1.
Figure 7:
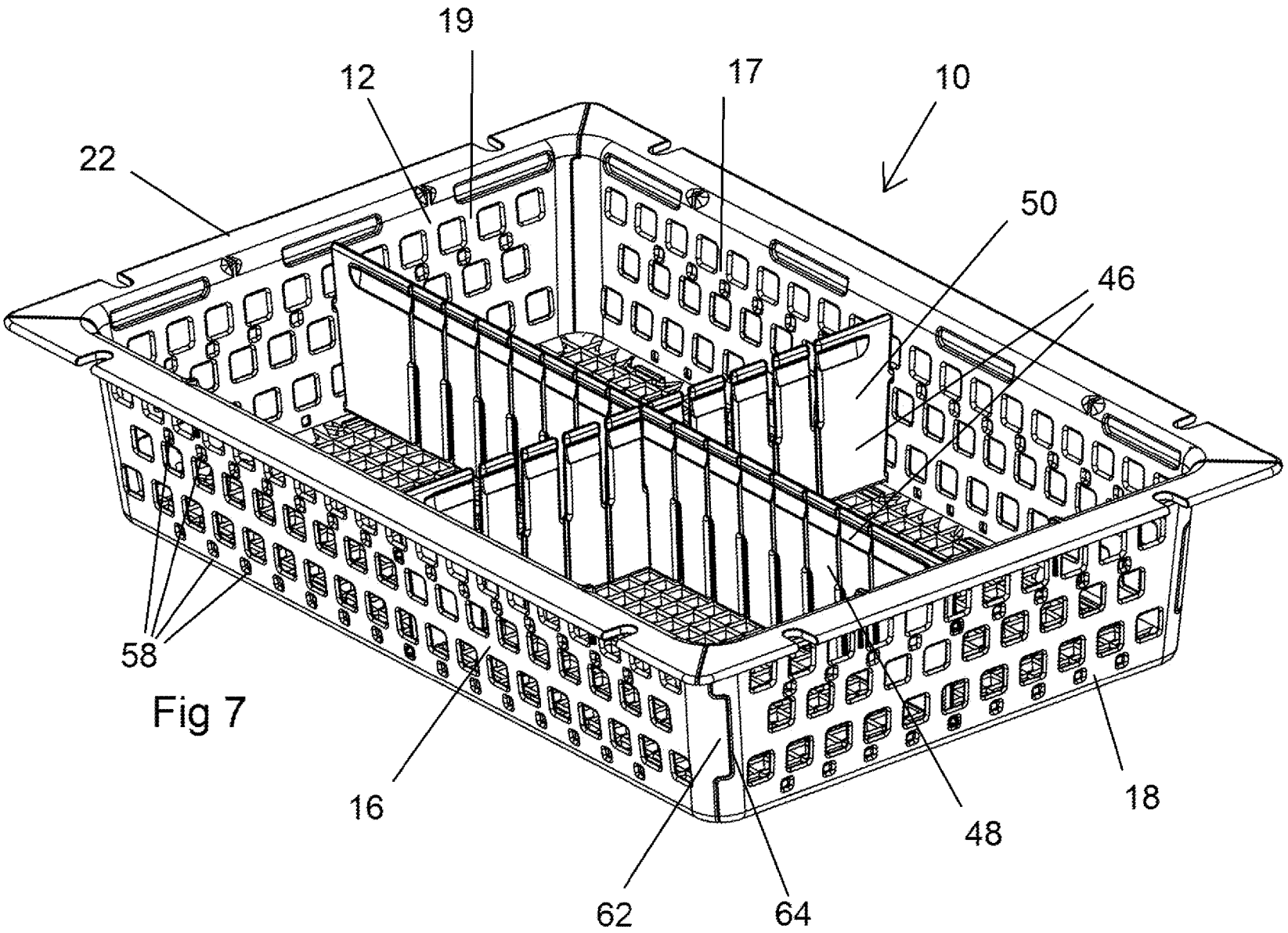
FIG. 7 is an upper perspective view of the basket of FIG. 1 shown incorporating a divider.
Figure 8:
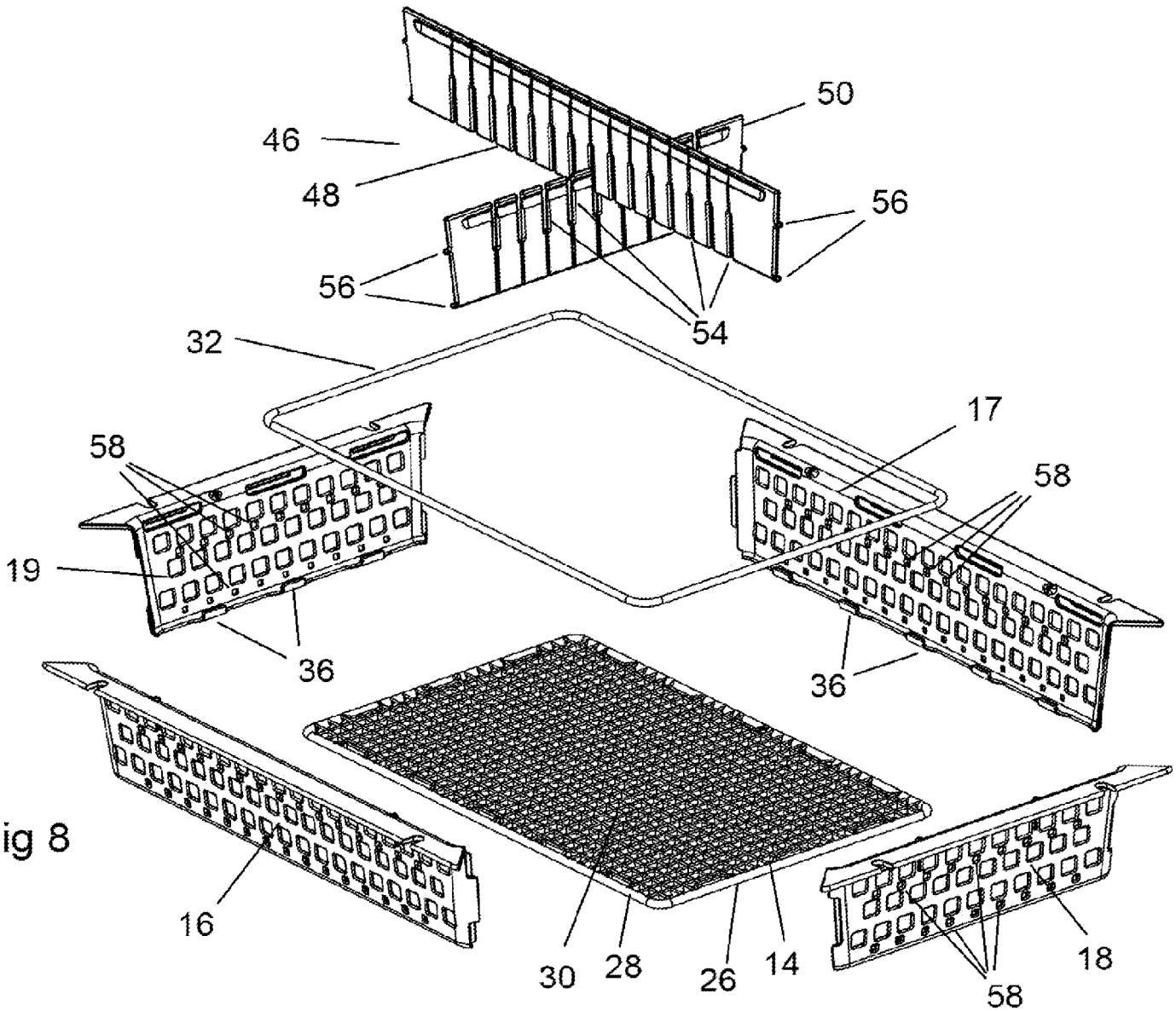
FIG. 8 is an exploded view of the basket of FIG. 7.
Figure 9:
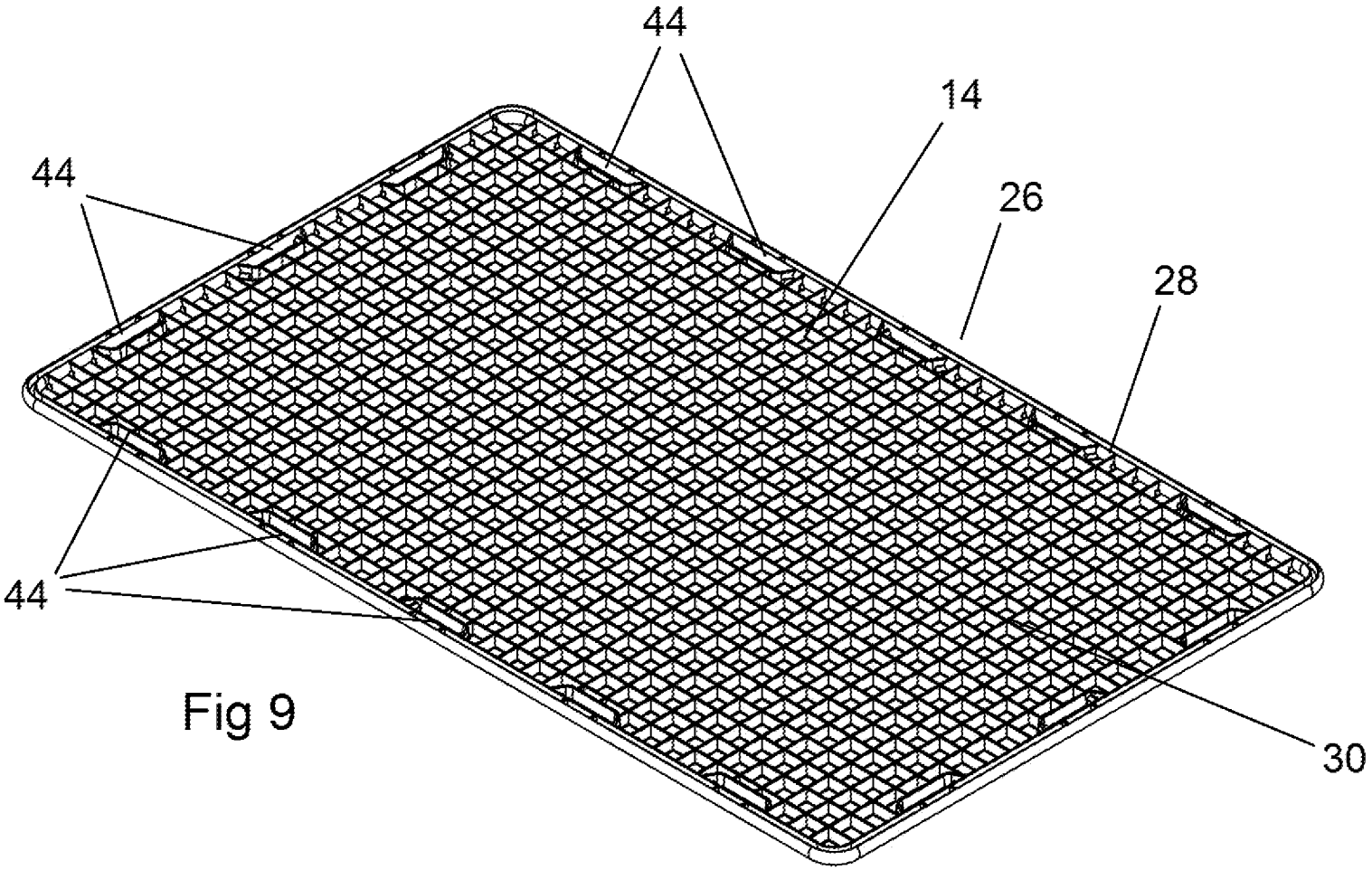
FIG. 9 is an upper perspective view of the base of the basket of FIG. 1.

Referring to the Figures, there is shown a basket 10 comprising generally an outer wall 12 and a base 14. The outer wall 12 is formed from first and second side walls 16 and 17 and first and second end walls 18 and 19. The first and second side walls 16 and 17 comprise generally planar members located parallel in use and the first and second end walls 18 and 19 also comprise planar members located parallel to each other. The end walls 18 and 19 extend between adjacent ends of the first and second side walls 16 and 17. The outer wall 12 formed by the first and second side walls 16 and 17 and the first and second end walls 18 and 19 is therefore generally rectangular in shape.

The first and second side walls 16 and 17 and the first and second end walls 18 and 19 are shaped such that when the side walls 16 and 17 and end walls 18 and 19 are connected, the outer wall 12 includes an inward taper from an upper end to a lower end thereof.

In the embodiment shown, each of the first and second side walls 16 and 17 and the first and second end walls 18 and 19 is formed from a single sheet of suitable material, such as a plastic material. The first and second side walls 16 and 17 and the first and second end walls 18 and 19 include a plurality of holes 20 therein to allow for air flow within the basket 10. In the embodiment shown, the holes 20 are provided in rows, with each row comprising a plurality of holes 20 spaced at regular intervals along the length of the side or end wall 16, 17, 18, 19.

Opposed ends of the side walls 16 and 17 and the end walls 18 and 19 are each provided with end connectors 60. The end connectors 60 are provided such that ends of each of the side walls 16 and 17 can engage with adjacent ends of the end walls 18 and 19.

In the embodiment shown, the end connectors 60 on the side walls 16 and 17 comprise curved tabs 62 located centrally on end edges of the side walls 16 and 17. The curved tabs 62 are provided to be received into corresponding recessed portions 64 provided centrally on end edges of the end walls 18 and 19. The curved tabs 62 are thinner than the side walls 16 and 17 and located adjacent an outer surface of the side walls 16 and 17. The recessed portions 64 include also a lip portion 66 located adjacent an inner surface of the end walls 18 and 19. The distal ends of the curved tabs 62 engage with the lip portions 66 in the recessed portions 64 of the adjacent end walls 18 and 19 to assist with securing the end walls 18 and 19 relative to the side walls 16 and 17.

The first and second side walls 16 and 17 and the first and second end walls 18 and 19 each include a lip portion 22 along a longitudinal edge, being the edge located uppermost in use. The lip portions 22 of each of the first and second side walls 16 and 17 and of the first and second end walls 18 and 19 are aligned such that a continuous upper lip is defined when the basket 10 is constructed.

The base 14 of the basket 10 is located in use extending between lower edges of the first and second side walls 16 and 17 and the first and the second end walls 18 and 19. The base 14 comprises a planar mesh tray 26. The mesh tray 26 comprises a rectangular outer frame 28 and an inner grill 30. The inner grill 30 is formed from a plurality of perpendicular cross members 38 extending across between the sides and ends of the outer frame 28. In the embodiment shown, the outer frame 28 and the inner grill 30 are integrally formed from a plastic material.

The first and second side walls 16 and 17 and first and second end walls 18 and 19 are secured together by a retaining loop 32. The retaining loop 32 comprises a rectangular frame formed of a suitable material, such as a metallic wire. The dimensions of the retaining loop 32 are such that the retaining loop 32 can be received around the periphery of the connected side and end walls 16, 17, 18, 19 from a lower end of the outer wall 12.

Each of the first and second side walls 16 and 17 and the first and second end walls 18 and 19 is provided with one or more securing clips 34. Each securing clip 34 comprises a projection 35 extending downwardly from a lower surface of the lip portion 22. The projections 35 comprise elongate projections located parallel to the adjacent side or end wall 16, 17, 18, 19 such that the projections 35 define downwardly facing recesses located between the projections 35 and the side and end walls 16, 17, 18, 19. The downwardly facing recesses are dimensioned to receive the retaining loop 32 in a snap fit type connection. In the embodiment shown where the loop 32 comprises a wire of circular cross section, inner faces of the projections 35 are arcuate such that the recesses are generally circular in transverse cross section to receive the loop 32.

Each of the first and second side walls 16 and 17 and the first and second end walls 18 and 19 are provided with one or more base connectors 36 on the lower edges thereof. The base connectors 36 each comprise an arcuate tab extending from an inner side of the side or end walls 16, 17, 18, 19. The arcuate tabs define upwardly facing channels provided to receive the outer frame 28 of the base 14.

The mesh tray 26 is also provided with apertures 44 at locations along the outer frame 28 corresponding to the locations of the base connectors 36. The apertures 44 are provide in the inner grill 30 adjacent the outer frame 28 such that the base connectors 36 are received in the apertures 44. The transverse cross sectional shape of the channels defined by the base connectors 36 corresponds to the transverse cross sectional shape of the outer frame 28 such that the outer frame 28 engages into the channels in a snap fit manner.

Figure 10:
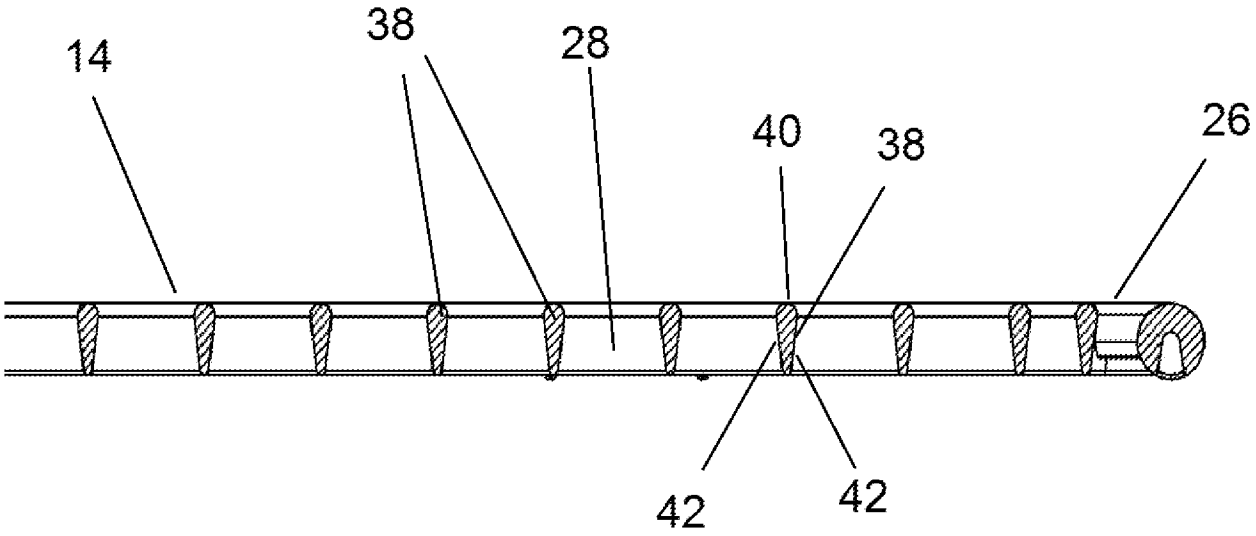
FIG. 10 is a cross sectional view of a portion of the base of FIG. 9.
Figure 11:
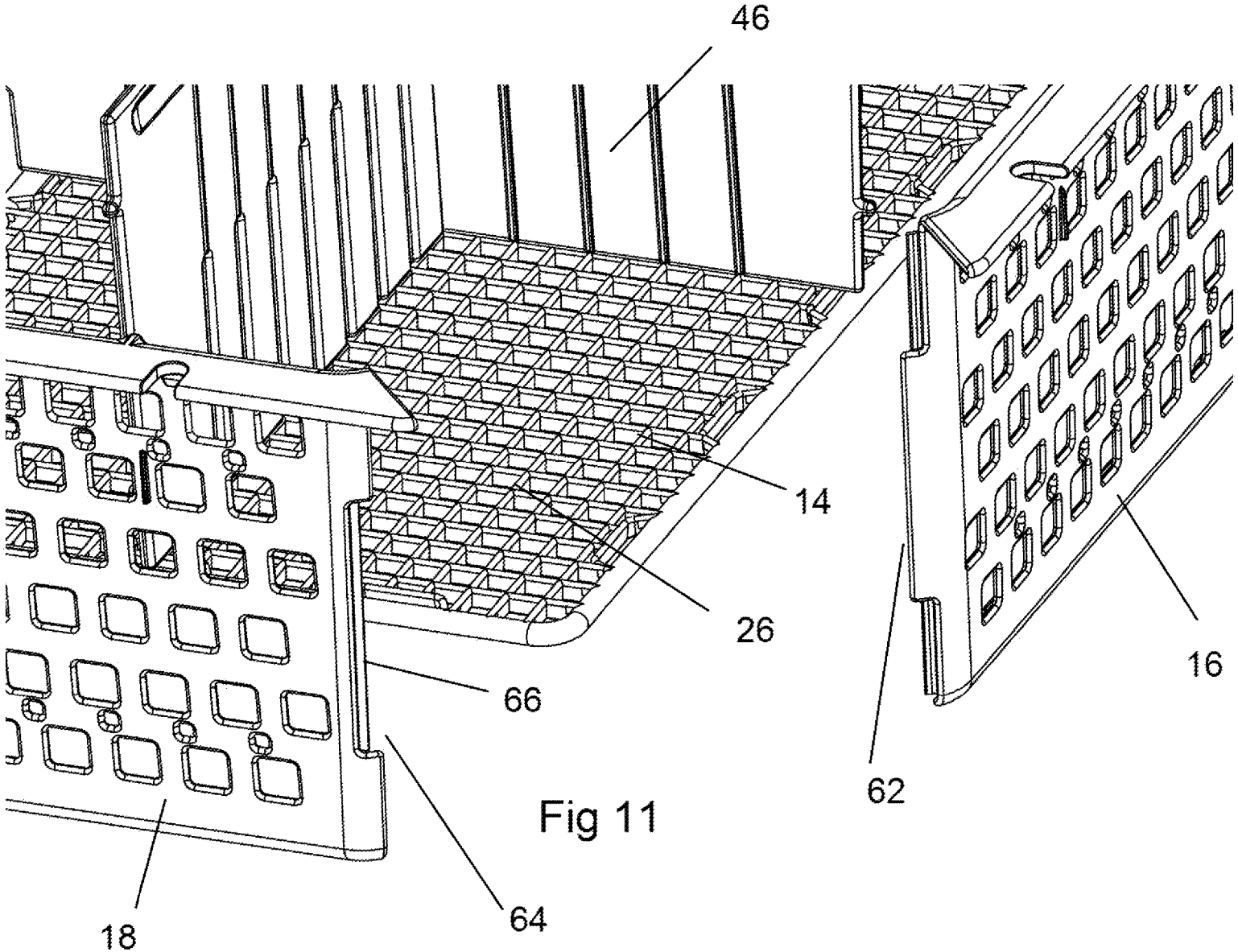
FIG. 11 is a first close up exploded view of ends of the side and end walls of the basket of FIG. 1.
Figure 12:
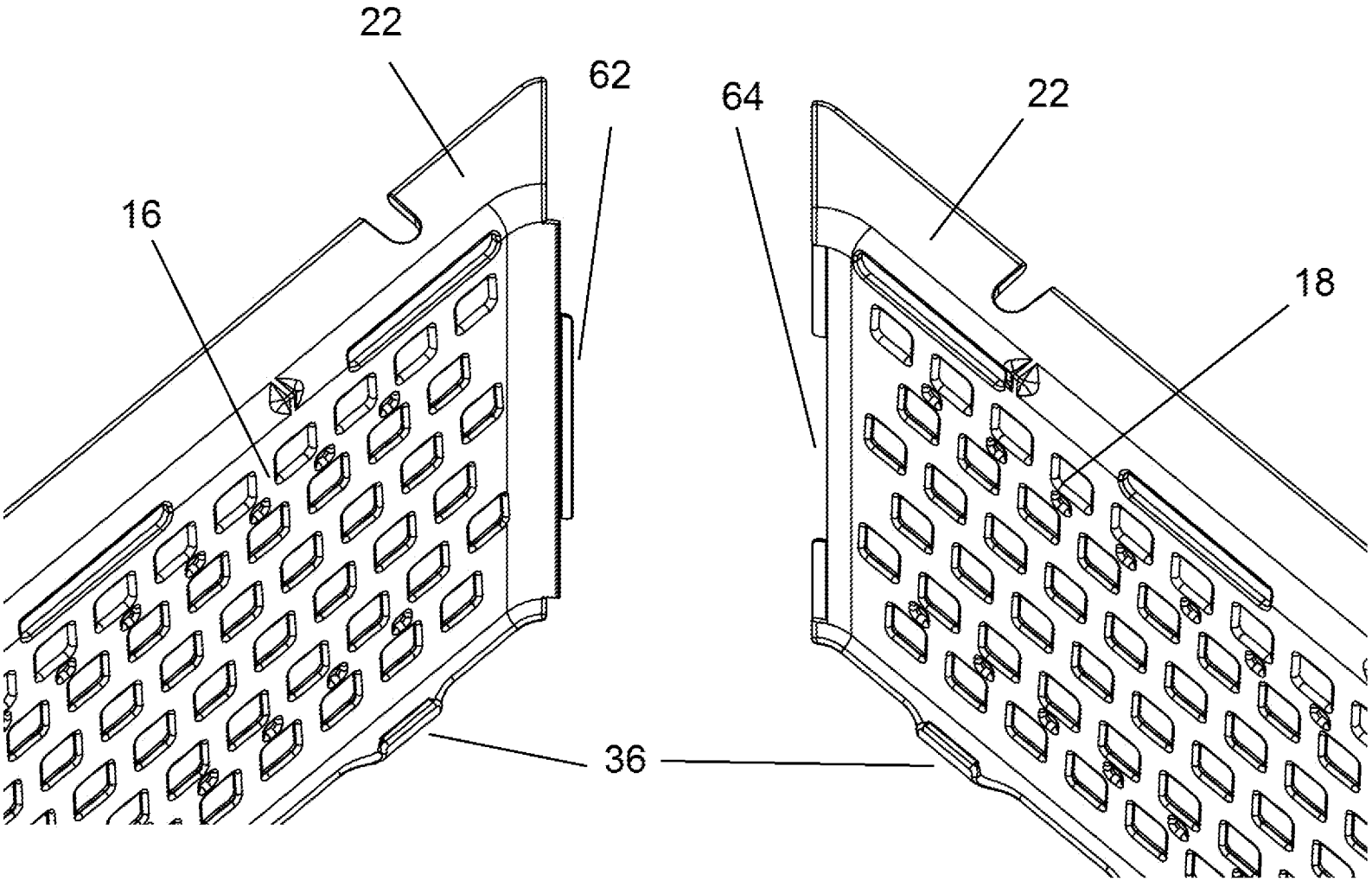
FIG. 12 is a second close up view of the ends of the side and end walls.
Figure 13A:
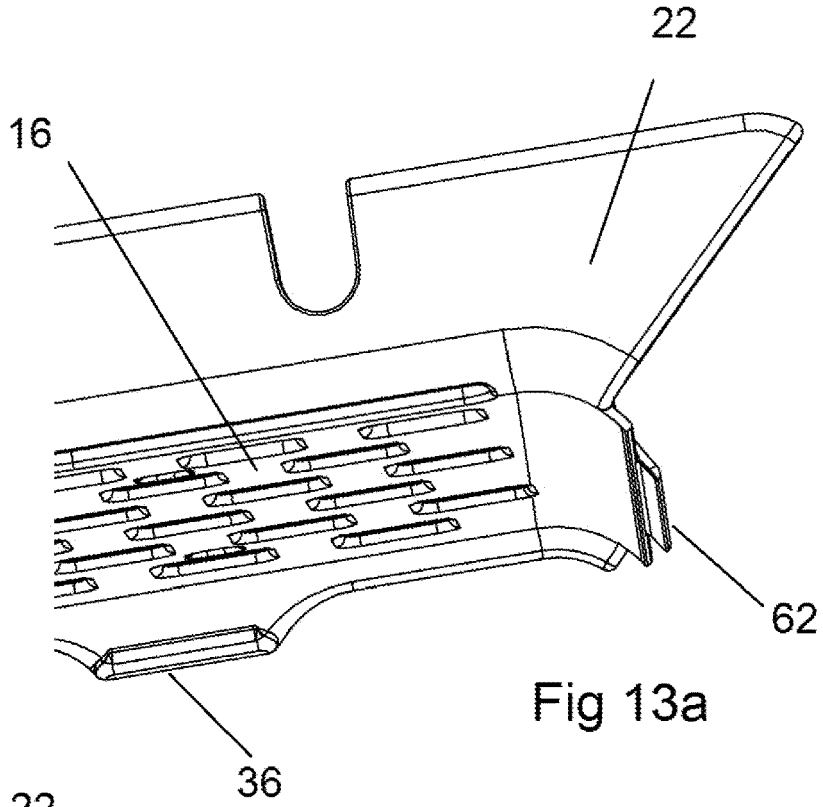
FIG. 13*a* is an upper perspective view of an end of a side wall of the basket.
Figure 13B:
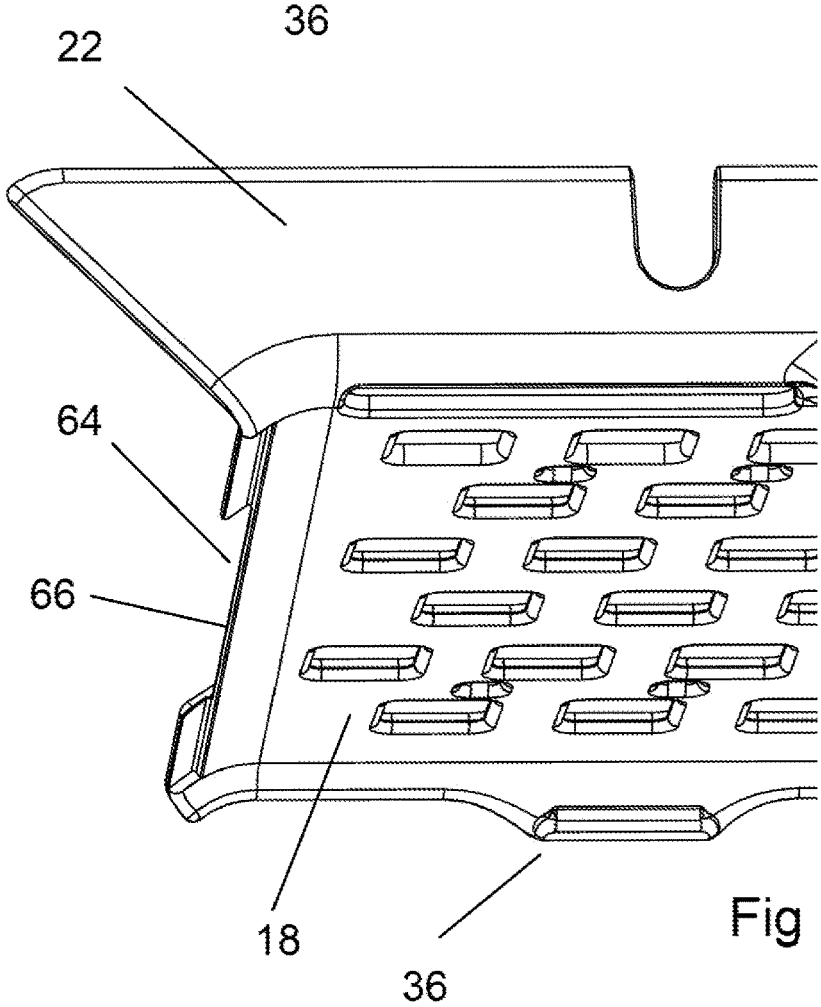
FIG. 13*b* is an upper perspective view of an end of an end wall of the basket.
Figure 14:
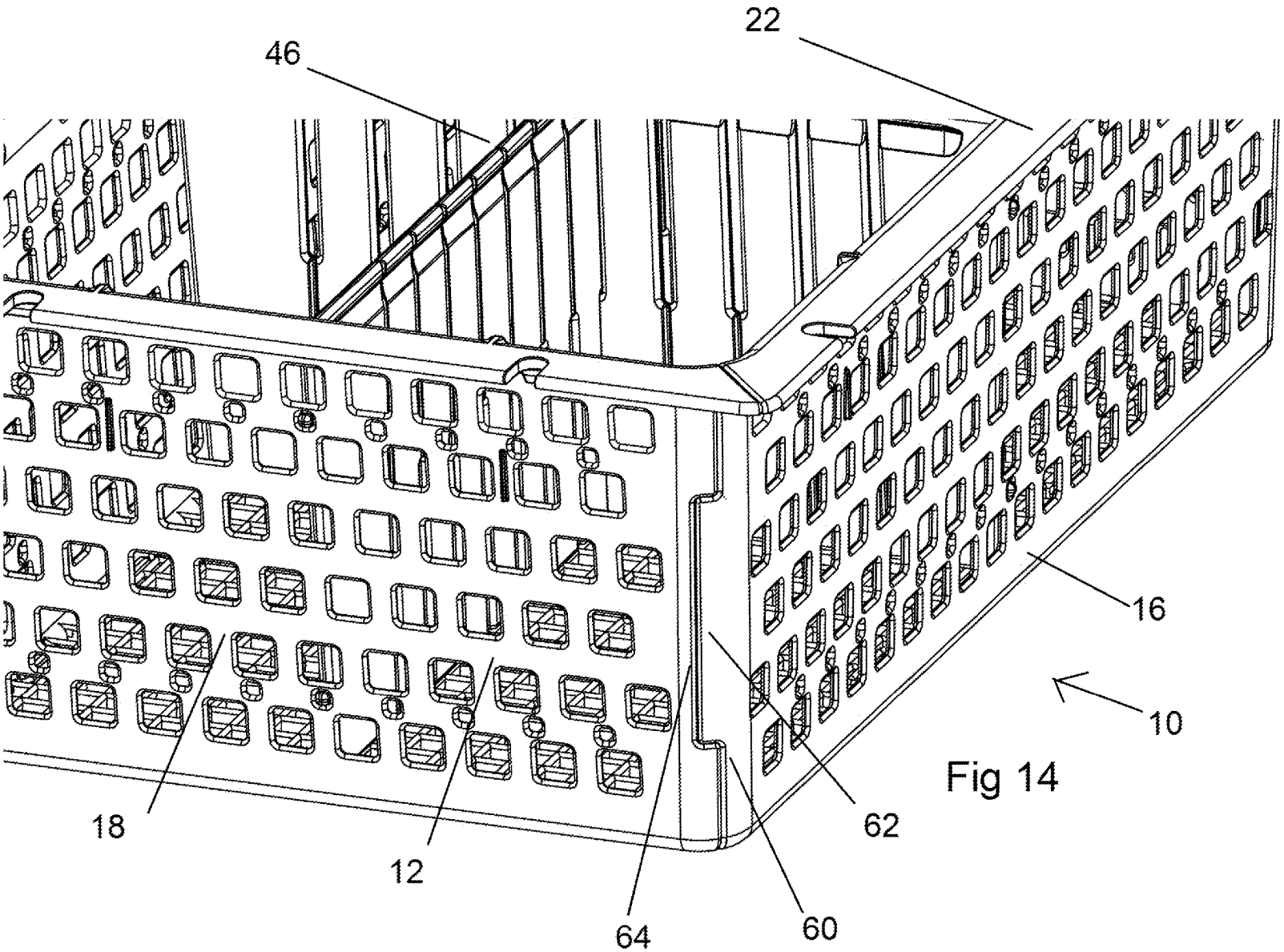
FIG. 14 is a close up view showing connection of adjacent side and end walls.

The cross members 38 of the inner grill 30 are teardrop-shaped in transverse cross section, as can be seen in FIG. 10. The cross members 38 include a rounded upper edge 40 and inwardly tapering sides 42 such that the width of the cross members 38 decreases towards the lower sides thereof. The rounded upper edge 40 and tapering sides 42 reduce the likelihood of dust or debris collecting on the upper surface of the mesh tray 26.

The basket 10 is also provided with a divider 46. The divider 46 comprises one or more first members 48 and one or more second members 50. The first and second members 48 and 50 each comprise a rectangular planar member. The first members 48 extend between the first and second ends 18 and 19 of the basket 10 and the second members 50 extend between the first and second sides 16 and 17.

The first members 48 include slots 54 extending inwardly from a lower edge thereof and the second members 50 include slots 54 extending inwardly from an upper edge thereof. The slots 54 of the first member 48 can be engaged into the slots 54 of the second member 50 to secure the first and second members 48 and 50 together at right angles to each other.

Ends of the first and second members 48 and 50 are provided with lugs 56 to be received in corresponding openings 58 in the side and end walls 16, 17, 18 and 19. In the embodiment shown, the ends of the first and second members 48 and 50 are each provided with a pair of lugs 58 thereon. Each of the side and end walls 16, 17, 18 and 19 is provided with a pair of corresponding rows of openings 58. The rows of openings 58 comprise a plurality of openings 58 provided at regular intervals along the length of the side and end walls 16, 17, 18 and 19 such that the first and second members 48 and 50 can be positioned at any required position relative to the side and end walls 16, 17, 18 and 19 by insertion of the lugs 56 into the appropriate pairs of openings 58.

In use, the basket 10 may be formed by locating the first and second side walls 16 and 17 and the first and second end walls 18 and 19 to form the outer wall 12 such that the end and side walls 16, 17, 18 and 19 are connected together by the end connectors 60. The retaining loop 32 may then be slid upwardly around the lower edges of the side and end walls 16, 17, 18 and 19 to engage into the securing clips 34 adjacent the upper edges of the side and end walls 16, 17, 18 and 19. The retaining loop 32 engages into the securing clips 34 of each of the side walls 16 and 17 and end walls 18 and 19 and thereby secures the side walls 16 and 17 and the end walls 18 and 19 together.

The base 14 may be inserted into the outer wall 12 downwardly until the outer frame 28 thereof engages into the upwardly facing channels formed by the base connectors 36. The basket 10 may therefore be transported in a disassembled, flat-packed configuration. When assembled, a secure basket 10 is formed having an open base through which liquid or other matter may fall. The inner surfaces of the side walls 16 and 17 and the end walls 18 and 19 are planar from upper edges to lower edges with no inward protrusions other than the base connectors 36 required to engage the base 14. Therefore any material falling downwardly along the side wall 16 and 17 or end walls 18 and 19 will pass directly through the basket 10, providing a hygienic design.

It will be readily apparent to persons skilled in the relevant arts that various modifications and improvements may be made to the foregoing embodiments, in addition to those already described, without departing from the basic inventive concepts of the present invention.

What is claimed is:

1. A basket comprising:

first and second side walls and first and second end walls;

a retaining loop being generally rectangular in shape to be located around outer surfaces of the first and second side walls and the first and second end walls to secure the first and second side walls and first and second end walls to form an outer wall of the basket;

a base extending between lower edges of the first and second side walls and the first and the second end walls, the base comprising a mesh tray formed from a rectangular outer frame and an inner grill;

one or more base connectors arranged at intervals on the lower edges of the first and second side walls;

wherein the base connectors each comprise an arcuate tab extending on an inner side of the side or end wall to define an upwardly facing channel to receive the outer frame of the base.

2. The basket in accordance with claim 1, further comprising:

a lip portion extending outwardly from upper edges of the side and end walls; and securing clips located adjacent lower sides of the lip portions of the end and side walls;

wherein the retaining loop is received in the securing clips.

3. The basket in accordance with claim 2, wherein the outer wall formed by the first and second side walls and the first and second end walls includes an inward taper from an upper end to a lower end thereof.

4. The basket in accordance with claim 2, wherein the securing clips each comprises a projection extending downwardly from a lower surface of the lip portion defining a downwardly facing recess located between the projection and the adjacent side or end wall.

5. The basket in accordance with claim 4, wherein the downwardly facing recesses are dimensioned to receive the retaining loop in a snap fit type connection.

6. The basket in accordance with claim 5, wherein the projections are elongate and parallel to the adjacent side or end walls and the retaining loop comprises a wire of circular cross section, and inner faces of the projections are arcuate such that the recesses are generally circular in transverse cross section to receive the retaining loop.

7. The basket in accordance with claim 1, wherein the inner grill of the mesh tray is formed from a plurality of cross members extending across between sides and ends of the outer frame.

8. The basket in accordance with claim 7, wherein apertures are provided in the inner grill of the base at locations along the outer frame corresponding to the locations of the base connectors such that the base connectors are received in the apertures.

9. The basket in accordance with claim 7, wherein the cross members are teardrop-shaped in transverse cross section such that the cross members include a rounded upper edge and inwardly tapering sides such that the width of the cross members decreases towards the lower sides.

10. The basket in accordance with claim 1, wherein the first and second side walls and the first and second end walls include a plurality of holes therein to allow for air flow within the basket.

11. The basket in accordance with claim 1, wherein the basket is provided with a divider comprising one or more first members and one or more second members wherein the first members extend between the first and second ends of the basket and the second members extend between the first and second sides.

12. The basket in accordance with claim 11, wherein ends of the first and second members are provided with lugs to be received in corresponding openings in the side and end walls.

13. The basket in accordance with claim 12, wherein the ends of the first and second members are each provided with a pair of lugs and each of the side and end walls is provided with a pair of corresponding rows of openings.

14. The basket in accordance with claim 1, wherein ends of the side walls and the end walls are each provided with end connectors such that ends of each of the side walls can engage with adjacent ends of the end walls.

15. The basket in accordance with claim 14, wherein the end connectors on the side walls comprise curved tabs located centrally on end edges of the side walls to be received into corresponding recessed portions provided centrally on end edges of the end walls.

16. The basket in accordance with claim 15, wherein the curved tabs are thinner than the side walls and located adjacent an outer surface of the side walls and the recessed portions include a lip portion located adjacent an inner surface of the end walls to engage with a distal end of the curved tabs.

17. The basket in accordance with claim 3, wherein the securing clips each comprises a projection extending downwardly from a lower surface of the lip portion defining a downwardly facing recess located between the projection and the adjacent side or end wall.

18. The basket in accordance with claim 8, wherein the cross members are teardrop-shaped in transverse cross section such that the cross members include a rounded upper edge and inwardly tapering sides such that the width of the cross members decreases towards the lower sides.

19. The basket in accordance with claim 9, wherein the first and second side walls and the first and second end walls include a plurality of holes therein to allow for air flow within the basket.

20. The basket in accordance with claim 13, wherein ends of the side walls and the end walls are each provided with end connectors such that ends of each of the side walls can engage with adjacent ends of the end walls.

* * * * *